US007055296B2

(12) United States Patent
Christ

(10) Patent No.: US 7,055,296 B2
(45) Date of Patent: Jun. 6, 2006

(54) METHOD FOR CONTROLLING A BLISTER PACKAGING MACHINE

(75) Inventor: Richard Christ, Emmelshausen (DE)

(73) Assignee: IWK Verpackungstechnik GmbH, Stutensee (DE)

( * ) Notice: Subject to any disclaimer, the term of this patent is extended or adjusted under 35 U.S.C. 154(b) by 0 days.

(21) Appl. No.: 10/508,555

(22) PCT Filed: Jan. 20, 2004

(86) PCT No.: PCT/EP2004/000381

§ 371 (c)(1),
(2), (4) Date: Sep. 22, 2004

(87) PCT Pub. No.: WO2004/065223

PCT Pub. Date: Aug. 5, 2004

(65) Prior Publication Data

US 2005/0138898 A1 Jun. 30, 2005

(30) Foreign Application Priority Data

Jan. 23, 2003 (DE) ..... 103 02 723

(51) Int. Cl.
*B65B 47/00* (2006.01)
*B65B 53/00* (2006.01)

(52) U.S. Cl. ..... 53/453; 53/77; 53/167; 53/561

(58) Field of Classification Search ..... 53/453, 53/559, 561, 77, 167
See application file for complete search history.

(56) References Cited

U.S. PATENT DOCUMENTS 4,172,347 A * 10/1979 Nitz ..... 53/77
4,525,977 A * 7/1985 Matt ..... 53/77
4,875,329 A 10/1989 Miselli
4,894,977 A * 1/1990 Rittinger et al. ..... 53/453
4,897,985 A * 2/1990 Buchko et al. ..... 53/559
4,951,444 A 8/1990 Epstein
5,603,203 A * 2/1997 Robache ..... 53/559
2002/0157355 A1 10/2002 Tampieri

FOREIGN PATENT DOCUMENTS

| | | |
|---|---|---|
| DE | 37 44 457 | 7/1988 |
| DE | 43 15 068 | 10/1994 |
| DE | 196 18 306 | 11/1997 |
| DE | 197 35 942 | 3/1999 |
| DE | 198 41 138 | 11/1999 |
| DE | 697 03 701 | 4/2001 |
| EP | 0 542 393 | 5/1993 |

* cited by examiner

*Primary Examiner*—Stephen F. Gerrity

(74) *Attorney, Agent, or Firm*—Paul Vincent

(57) ABSTRACT

A method for controlling a blister packaging machine has a work station which at least operates in cycles and which performs at least one first adjusting motion for a time period $T_{V1}$ during one work cycle, followed by a treatment state for a time period $T_B$, in which a product and/or material is treated. A second adjusting motion is then performed for a time period $T_{V2}$ followed by a resting state for a time period $T_R$. The time periods $T_{V1}$, $T_B$, $T_{V2}$ and $T_R$ and a cycle rate R (=cycles/min) of the packaging machine are preset and at least the cycle rate R can be changed to a different cycle rate $R_V$ using an input device. A cycle time difference ΔT which results from the changed cycle rate $R_V$ is substantially used to change the duration $T_R$ of the resting state. The time periods $T_{V1}$, $T_B$ and $T_{V2}$ preferably remain unchanged when entering a different cycle rate $R_V$.

11 Claims, 3 Drawing Sheets

METHOD FOR CONTROLLING A BLISTER PACKAGING MACHINE

This application is the national stage of PCT/EP2004/000381 filed on Jan. 20, 2004 and also claims Paris Convention priority of DE 103 02 723.8 filed Jan. 23, 2003.

BACKGROUND OF THE INVENTION

The invention concerns a method for controlling a blister packaging machine having at least one work station which operates in cycles and performs at least one first adjusting motion for a time period $T_{V1}$ during one work cycle, assumes a subsequent treatment state for a time period $T_B$ in which a product and/or material is/are treated, and performs a second adjusting motion for a time period $T_{V2}$ which is optionally followed by a resting state for a time period $T_R$, wherein the time periods $T_{V1}$, $T_B$, $T_{V2}$ and $T_R$ and a resulting cycle rate R (=cycles/min) of the packaging machine are preset and at least the cycle rate R can be changed to a different cycle rate $R_V$ using an input means.

A blister packaging machine of conventional structure comprises a forming station, in which a plurality of cup-shaped depressions are formed into a bottom sheet which consists of plastic material or aluminium, into which a product, e.g. a pharmaceutical tablet is inserted in a downstream filling station. After product supply, the bottom sheet is passed to a sealing station. A cover sheet is fed directly before or within the sealing station and disposed on the bottom sheet. The cover sheet is sealed tightly onto the bottom sheet in the sealing station using heat thereby enclosing the product in the cup-shaped depression.

The forming station is operated in cycles and therefore discontinuously. The sealing station can also be operated in cycles or, alternatively, continuously, wherein conventional compensation means effect transfer between cyclical operation of the forming station and continuous operation of the sealing station.

The efficiency of a blister packaging machine mainly depends on the cycle rate R, i.e. the number of cycles to be effected per minute. The cycle rate R defines the maximum cycle time $T_{max}$ available for a working cycle in milliseconds with $T_{max}$=60,000/R [ms], i.e. at a cycle rate R of 75 cycles/min, the maximum cycle time $T_{max}$=800 ms. A graph of a corresponding working cycle is shown in FIG. 2 in the form of a simplified polygonal path-time-diagram and is briefly explained below.

The cyclically operated forming station, on which the following example is based, must carry out various motions, treatments, or processes within the maximum cycle time $T_{max}$. Departing from a basic or zero position at the beginning of the cycle (point 0 in FIG. 2), in which two forming plates, between which the bottom sheet to be formed extends, are completely separated, a first adjusting motion, i.e. the closing motion of the forming plates is initially carried out. The closing path $s_V$ is defined by the technical production requirements and the closing motion is performed over a predetermined time period $T_{V1}$ until point 1 (FIG. 2) is reached, at which time the forming plates are closed and have reached their final position.

The forming plates have now assumed their treatment state in which e.g. a pre-heated plastic bottom sheet is cooled for a time period $T_B$, wherein the cup-shaped depressions are additionally formed in the bottom sheet, in particular using compressed air or forming dies. At point 2 of the cycle curve, cooling or treatment of the bottom sheet is completed and is followed by a second adjusting motion, i.e. the opening motion of the forming plates, which is effected again via path $S_V$ (however, in the opposite direction) over a time period $T_{V2}$. At the end of the opening motion, i.e. at point 3 of the cycle curve, the initial position has been reached again. The opened forming plates can subsequently be maintained at a resting state for a time period $T_R$. The duration of the time period $T_R$ of the resting state depends mainly on influences external to the forming station and may advantageously be very short or even 0.

As soon as the forming plates are opened to a sufficient degree, further transport of the bottom sheet can be initiated and performed. In FIG. 2, it is assumed that the further transport of the bottom sheet starts when the forming plates have been moved apart by a distance $S_V/2$, i.e. a time period $t_{Z1}$ is available for further transport of the bottom sheet to the end of the cycle, and a time period $t_{Z2}$ from the start of the subsequent cycle to the time when the forming plates are again half closed, which produces a total transport time $T_Z$ from the sum of $t_{Z1}$ and $t_{Z2}$.

In older blister packaging machines, the curve shapes were mechanically defined by rotating cam plates whose rotary motion was derived from a centrally driven main shaft, the so-called king shaft. In modern blister packaging machines, the curves are stored in software and the motor drive of the adjusting motions is effected via servomotors which are controlled by control electronics or corresponding software.

When a blister packaging machine is adjusted to a certain blister format, the motional sections of the cycle curve are usually designed such that they optimally satisfy the process requirements and at the same time can be performed at a maximum cycle rate. The individual cycle steps should thereby be carried out with high reliability and precision and with high efficiency, i.e. high performance of the packaging machine should be obtained. The determined format-specific process data is stored. If the blister packaging machine is to process blisters of the same format at a later time, the stored data is recovered and the packaging machine is correspondingly operated. This process is based on the theoretical idea that the same blister format can always be optimally processed with the same stored process parameters.

Practice has shown that operation of the blister packaging machine which is part of a larger packaging system can cause unexpected problems which reduce the efficiency of the packaging system. These problems may be based on disturbances of individual stations of the blister packaging machine or also disturbances or problems in upstream or downstream systems, e.g. in a downstream cartoning machine. There can be variations in the leaflet material or folding box material in the cartoning machine which would preclude maintaining the preset relatively high cycle rate. Moreover, there could be cycle problems in downstream machines, e.g. in a bundle packer, or product tolerances which have a negative effect on the speed of product supply in the blister packaging machine. In addition, there may be a shortage of staff for the entire packaging system due to illness and/or holidays, with the consequence that the processing speed thereof must be reduced.

Since the above-mentioned problems and disturbances cannot always be eliminated or counteracted immediately, operation of the blister packaging machine is conventionally continued either with an increased rejection rate or reduced packaging quality. If this should not be acceptable, the system is stopped until the cause of the error is eliminated.

In terms of technical control, it would also be possible to reduce the cycle rate of the blister packaging machine and possibly of other machines in the packaging line. This measure could, however, change the forming and sealing parameters to such an extent that perfect forming and sealing processes are no longer guaranteed.

The following is based on an example, wherein the blister packaging machine cannot be operated at an originally preset maximum cycle rate R of e.g. 75 cycles per minute, since the dimensions of the tablets have slightly changed and therefore move at a slightly reduced speed through the supply channels of the filling station. If the cycle rate were not changed, the portion of blisters which are incompletely filled, would increase drastically. Problems in other machines of the packaging line could also require a reduction in the cycle rate.

If the cycle rate R is reduced to a different cycle rate $R_V$ to prevent an increased portion of improperly filled blisters, each cycle has a higher maximum cycle time $T_{max}$. If the cycle rate R of 75 cycles per minute is reduced to a different cycle rate $R_V$ of 50 cycles per minute, a new maximum cycle rate $T_{max}$=60,000/50=1,200 (ms) is obtained. In a conventional blister packaging machine, the basic behavior of the stored, cycle curve is maintained, with all time periods $T_{V1}$, $T_B$, $T_{V2}$ and $T_R$ being extended by a factor of 1,200/800=1.5. A correspondingly extended cycle curve is shown in FIG. 3. The figure shows that the duration $T_B$ of the treatment, e.g. a forming or cooling process of the bottom sheet is increased by 50%. Moreover, the duration of the first and second adjusting motions is increased in such an extended cycle curve which can reduce the advance speed thereby extending the cooling time of the pre-heated bottom sheet during the transport period. Changing of the process parameters can cause erroneously or incompletely shaped cups.

It is the underlying purpose of the invention to provide a method for controlling a blister packaging machine, wherein the cycle rate can be arbitrarily changed within predetermined limits in the production phase without causing problems during the packaging process and, in particular, during forming of the bottom sheet or during sealing of the cover sheet.

SUMMARY OF THE INVENTION

This object is achieved in accordance with the invention with a method having the characterizing features of the independent claim substantially using a cycle time difference ΔT resulting from the changed cycle rate $R_V$ to change the duration $T_R$ of the resting state.

If the cycle rate R is reduced to the changed cycle rate $R_V$, one obtains a time increase with respect to the maximum cycle time $T_{max}$ or cycle time difference ΔT, which is 400 ms (=1,200 ms−800 ms) in the above-mentioned example. The invention is based on the fundamental idea of not uniformly distributing this cycle time difference ΔT throughout all curve sections of the cycle curve, i.e. to conventionally compress or expand the cycle curve, rather to substantially or even completely use the cycle time difference ΔT to change the duration $T_R$ of the resting state. In this manner, the essential process parameters, i.e. the duration $T_{V1}$ of the first adjusting motion, the duration $T_B$ of the operating state and the duration $T_{V2}$ of the second adjusting motion can be kept within narrow limits which is favorable for the process development. In a preferred embodiment of the invention, the mentioned time intervals $T_{V1}$, $T_B$ and $T_{V2}$ are kept unchanged while inputting a different cycle rate $R_V$ thereby completely using the cycle time difference ΔT to change the duration $T_R$ of the resting state.

The work station whose cycle curve changes when the cycle rate is changed may be a forming station of a blister packaging machine. The forming station has two forming plates which can be adjusted relative to each other and between which a bottom sheet having cup-shaped receptacles is provided. If the bottom sheet is made from plastic material, it is processed in a pre-heated state and cooled in the forming station. The first adjustment motion is then provided by the closing motion of the forming plates, wherein the closing motion is terminated only when the final position of the forming plates has been reached, and the forming plates may already abut in the last motional phase of the closing motion. At the end of the closing motion, the forming plates remain in a treatment state for a time period $T_B$, in which the bottom sheet is shaped and optionally cooled. The second adjusting motion is the opening motion of the forming plates which return into their initial open position. The forming plates subsequently remain in their open position for a time period $T_R$. If the cycle time difference ΔT, obtained through reduction of the cycle rate is used completely to change the duration $T_R$ of the resting state and the temperature of the pre-heated sheet remains the same, the actual treatment of the bottom sheet in the forming station of the blister packaging machine does not change and the forming plates move at the preset speed. Reduction of the cycle rate merely causes the forming plates to remain in their open position for a longer period at the end of the cycle. Keeping the time periods $T_{V1}$, $T_B$ and $T_{V2}$ constant keeps the process-relevant parameter of the forming time constant thereby providing good shaping of the bottom sheet and at the same time providing high processing reliability.

Alternatively, the work station may be a sealing station with sealing plates which can be adjusted relative to each other and between which a cover sheet is sealed onto the bottom sheet. In this case, the first adjusting motion is the closing motion of the sealing plates which remain in a treatment state at the end of the closing motion for a time period $T_B$ in which the cover sheet is sealed onto the bottom sheet. The second adjusting motion is the opening motion of the sealing plates, wherein the sealing plates remain in the reached open position for a time period $T_R$. In this case, keeping the time periods $T_{V1}$, $T_B$ and $T_{V2}$ constant keeps the process-relevant parameter, namely the sealing time, constant.

The desired changed cycle rate $R_V$ (=cycles per minute) is preferably entered directly using the input means, wherein a processing unit determines the maximum available cycle time $T_{max}$=1/R [min]=60,000/R [ms] from the input different cycle rate $R_V$.

In a preferred embodiment of the invention, the changed cycle rate $R_V$ to be entered cannot assume any value, and in particular, cannot become too small. For this reason, a cycle difference ΔR resulting from the preset cycle rate R and the changed cycle rate $R_V$ is limited to a limit value $\Delta R_G$. The limit value $\Delta R_G$ may be in the range of 20% to 30% of the preset cycle rate R and is preferably 25% of the preset cycle rate R.

Further details and features of the invention can be extracted from the following description of an embodiment with reference to the enclosed drawing.

DESCRIPTION OF THE PREFERRED EMBODIMENT

Figure 1:
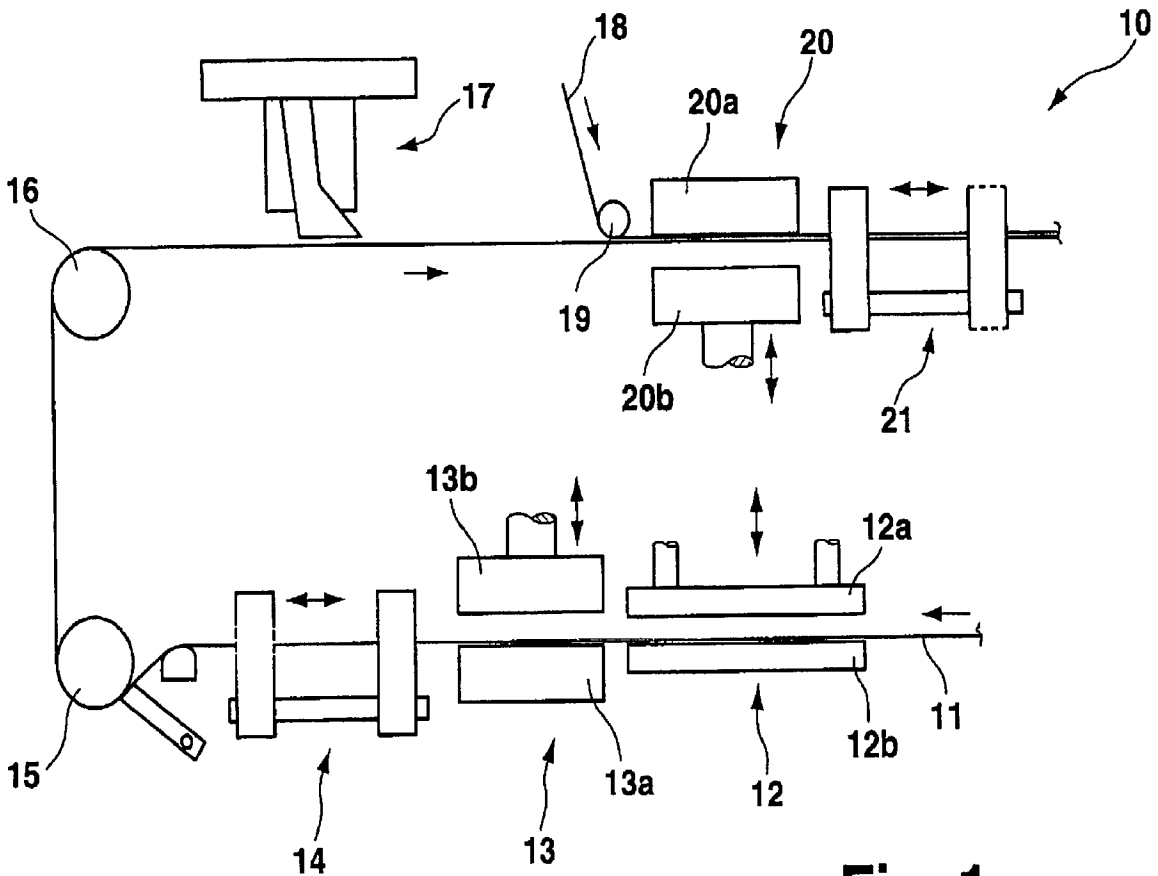
FIG. 1 shows a schematic illustration of the essential components of a blister packaging machine.

FIG. 1 schematically shows the essential components of a blister packaging machine 10. A plastic bottom sheet 11 is delivered by a supply and initially fed to a heating station 12 which comprises a lower heating plate 12*b* and an upper heating plate 12*a* which can be adjusted relative to the lower heating plate 12*b*. When the two heating plates 12*a* and 12*b* are closed, the bottom sheet received therebetween is heated.

A forming station 13 is directly adjacent to the heating station 12 and comprises a lower forming plate 13*a* and an upper forming plate 13*b* which can be adjusted relative thereto. The two forming plates 13*a* and 13*b*, which are shown in the open position, can be closed thereby cooling the bottom sheet which is received between the closed forming plates 13*a* and 13*b* and at the same time provided with cup-shaped depressions via a compressed air supply or forming dies. The forming station 13 is followed by a transport device 14 for pulling the bottom sheet 11 in cycles through the individual stations.

The bottom sheet 11 which is provided with the cup-like depressions is then supplied to a filling station 17 via deflecting rollers 15 and 16, in which a product, e.g. a pharmaceutical tablet, is inserted into each depression. The bottom sheet 11 travels to a sealing station 20. A cover sheet 18 is disposed onto the bottom sheet 11 directly before the sealing station 20 via a deflecting roller 19. The cover sheet 18 is sealed onto the bottom sheet 11 in the sealing station 20, which comprises a lower sealing plate 20*b* and an upper sealing plate 20*a*, by closing the warm sealing plates 20*a* and 20*b* and under thermal action on the sheets. The sealing station 20 is followed by a further transport device 21 whose motion is synchronized with the transport device 14 and provides cyclic transport of the sheet composite provided after the sealing station 20.

Figure 2:
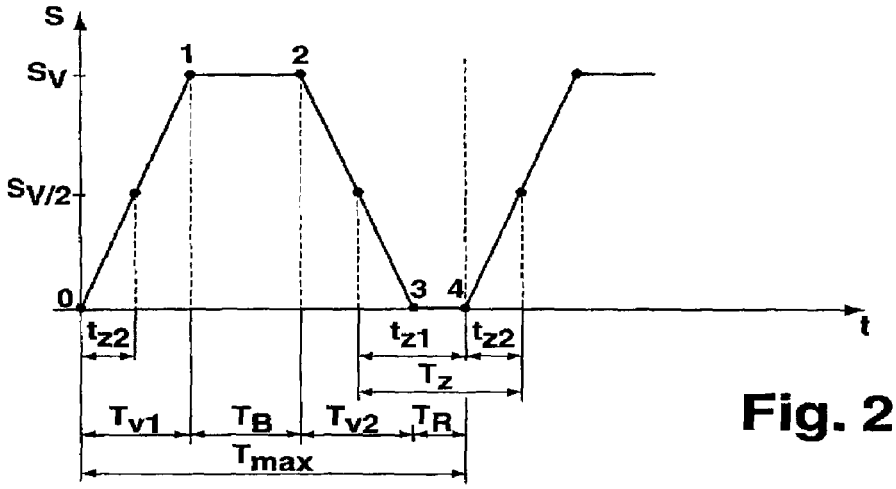
FIG. 2 shows a simplified normal cycle curve as path-time-diagram.
Figure 3:
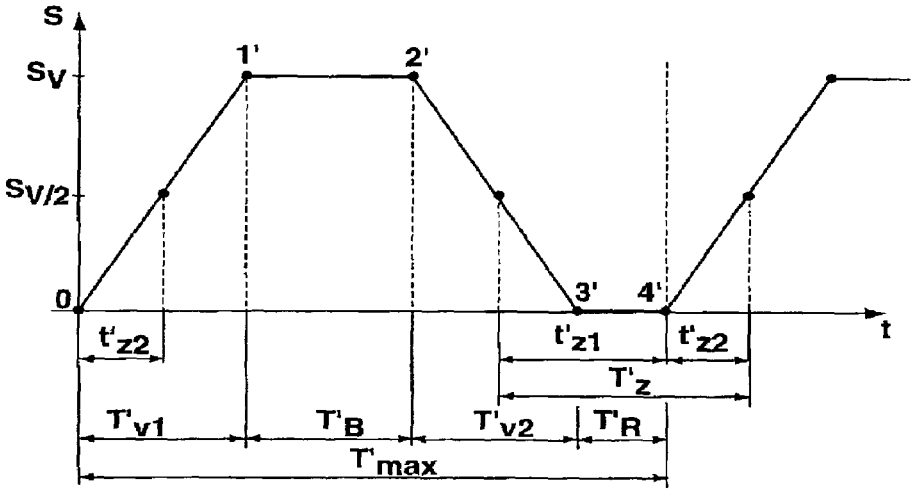
FIG. 3 shows the cycle curve in accordance with FIG. 2, stretched by a factor of 1.5.

FIG. 2 shows the above-explained simplified path-time-diagram of a cycle curve of e.g. the forming station 13. The assumed maximum cycle time $T_{max}$ is 800 ms which corresponds to a cycle rate R of 75 cycles per minute. The two forming plates 13*a* and 13*b* start from an open base position and are closed within a time period $T_{V1}$ thereby moving along the closing path $S_V$ as defined by production considerations. As soon as the forming plates 13*a*, 13*b* have reached the final position of their closing motion (point 1 of the curve in FIG. 2*a*), the treatment state starts, which then extends over a time period $T_B$. During the treatment state, the bottom sheet is provided with cup-shaped depressions. If the bottom sheet is made from plastic material, it is also cooled. The treatment state is finished at point 2 of the curve and the forming plates 13*a* and 13*b* are subsequently opened via path $S_V$ in an opposite direction to the closing motion and over a time period $T_{V2}$. The initial open position of the forming plates 13*a* and 13*b* is again reached at the end of the opening motion at point 3 of the curve in which they remain in a resting state for a time period $T_R$ until the next cycle starts.

In FIG. 2 it was assumed that the further transport of the sheet starts or ends with half-opened forming plates 13 and 13*b*, to obtain a total transport time $T_Z=t_{Z1}+t_{Z2}$.

If the user notices that this total transport time $T_Z$ is insufficient, he/she can reduce the preset cycle rate R. Towards this end, the user will predetermine a reduced cycle rate $R_V$ (=cycles per minute) to define the maximum available cycle time $T_{max}=60{,}000/R_V$ [ms]. If the user fixes the cycle rate $R_V$ e.g. at 60 cycles per minute, this corresponds to a changed maximum cycle time $T_{max}=1{,}000$ ms.

Figure 4:
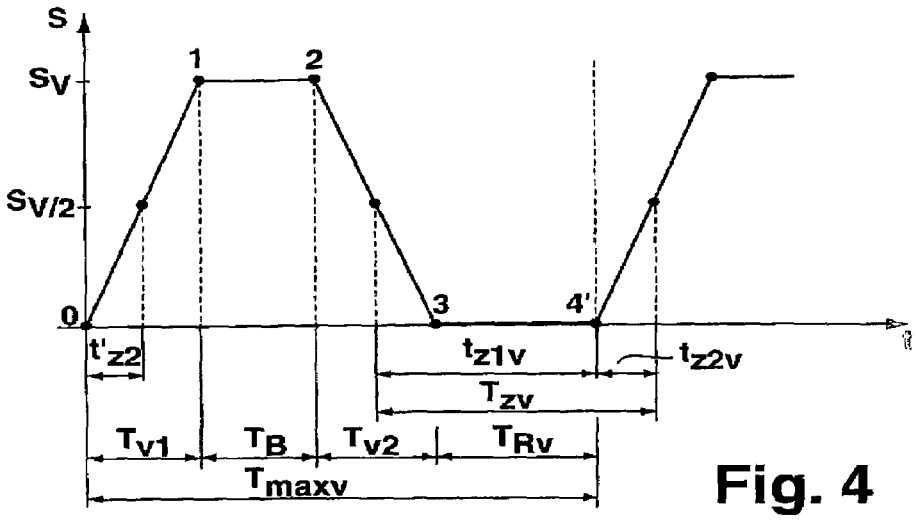
FIG. 4 shows an inventive modified cycle curve.

When the cycle rate is changed or reduced, the process parameters for the closing motion of the forming plates, for the treatment state and the opening motion of the forming plates are maintained such that the cycle curve between points 1 and 3 does not change (FIG. 4). Since the cycle rate $R_V$ was reduced to 60 cycles per minute, the maximum cycle time $T_{maxV}$ was increased to 1,000 ms, and one obtains for the changed, reduced cycle rate $R_V$, compared to the original cycle rate R, a cycle time difference ΔT of 200 ms which is completely associated with the resting state such that the forming plates remain in their completely opened position for a longer time period $T_{RV}$, thereby also substantially extending the transport time $T_{ZV}$ of the sheets (FIG. 4) such that the transport speed of the sheets can be adjusted to a value which is suited for the sheet material.

Figure 5:
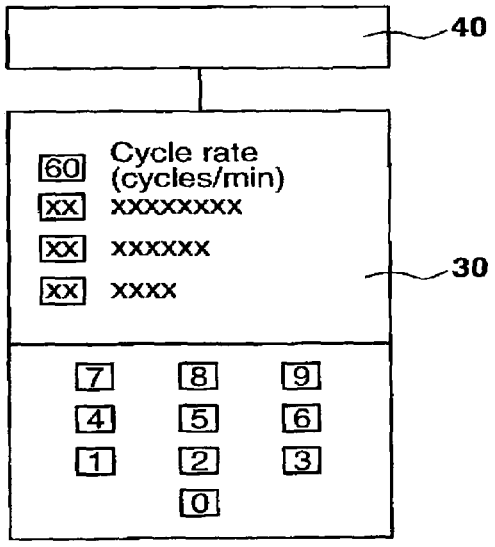
FIG. 5 shows a schematic plan view of an input means.

FIG. 5 shows that the input device 30 is associated with a processing unit 40 which determines the corresponding cycle curve from the input value for the changed cycle rate $R_V$ and checks, in particular, whether or not the input value of the cycle rate is within the predetermined limits.

I claim:

1. A method for controlling a blister packaging machine having a work station, the method comprising the steps of:

a) selecting a first cycle rate R (cycles/min);

b) selecting a time period $T_{V1}$, for performing a first adjusting motion within a work cycle;

c) selecting a time period $T_B$, immediately following $T_{V1}$, for performing a treatment process on a product or material within the work cycle;

d) selecting a time period $T_{V2}$, immediately following $T_B$, for performing a second adjusting motion within the work cycle;

e) selecting a resting time period $T_R$, immediately following $T_{V2}$, before beginning a next cycle;

f) selecting a second cycle rate $R_V$ using an input means;

g) calculating a cycle time difference ΔT between the first and second cycle rates; and h) changing a time duration of the resting time period $T_R$ substantially by the time difference ΔT.

2. The method of claim 1, wherein the time periods $T_{V1}$, $T_B$ and $T_{V2}$ remain substantially unchanged when the second cycle rate $R_V$ is input.

3. The method of claim 1, wherein the work station is a forming station with forming plates which can be adjusted relative to each other and between which a bottom sheet is provided having cup-shaped receptacles.

4. The method of claim 3, wherein the first adjusting motion is a closing motion of the forming plates, the bottom sheet is provided with the cup-like depressions during the treatment process, and the second adjusting motion is an opening motion of the forming plates, wherein the forming plates are completely opened in the resting time period.

5. The method of claim 1, wherein the work station is a sealing station with sealing plates which can be adjusted relative to each other and between which a cover sheet is sealed onto the bottom sheet.

6. The method of claim 5, wherein the first adjusting motion is a closing motion of the sealing plates, and the cover sheet is sealed onto the bottom sheet during the treatment process, with the second adjusting motion being an opening motion of the sealing plates, wherein the sealing plates are completely open in the resting time period.

7. The method of claim 1, wherein the second cycle rate $R_V$ (=cycles per minute) is input directly using the input means, wherein a processing unit determines a maximum cycle time $T_{max}=1/R_V$ [min]=60,000/$R_V$ [ms].

8. The method of claim 1, wherein a cycle difference $\Delta R$ resulting from the first cycle rate R and the second cycle rate $R_V$ is limited to a limit value $\Delta R_G$.

9. The method of claim 8, wherein the limit value $\Delta R_G$ is either between 20% and 30% or 25% of the first cycle rate R.

10. The method of claim 1, wherein the second cycle rate $R_V$ can be entered during operation of the blister packaging machine.

11. The method of claim 1, wherein the second cycle rate $R_V$ produces a change in a duration $T_R$ of the resting time period in a forming station as well as in a sealing station.

* * * * *